US009119001B2

(12) United States Patent
Yeh

(10) Patent No.: US 9,119,001 B2
(45) Date of Patent: Aug. 25, 2015

(54) ELECTRONIC DEVICE HAVING LOUDSPEAKER MODULE

(71) Applicant: Chi Mei Communication Systems, Inc., New Taipei (TW)

(72) Inventor: Chien-Feng Yeh, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 53 days.

(21) Appl. No.: 13/940,621

(22) Filed: Jul. 12, 2013

(65) Prior Publication Data

US 2014/0177902 A1 Jun. 26, 2014

(30) Foreign Application Priority Data

Dec. 24, 2012 (TW) ..... 101149465 A

(51) Int. Cl.
*H04R 1/02* (2006.01)
*H04R 1/28* (2006.01)
*H04R 1/22* (2006.01)

(52) U.S. Cl.
CPC ..... *H04R 1/2803* (2013.01); *H04R 1/227* (2013.01); *H04R 2499/11* (2013.01)

(58) Field of Classification Search
CPC ..... H04R 1/02; H04R 1/025; H04R 1/026; H04R 5/02; H04R 2499/15; H04R 1/2819; H04R 1/2826; H04R 1/345; H04R 1/2842; H04R 1/26; H04R 1/24; H04R 1/323; H04R 1/227; H04R 1/403; H05N 5/642
USPC ..... 381/345, 386, 388; 181/144, 145, 198, 181/199
See application file for complete search history.

(56) References Cited

U.S. PATENT DOCUMENTS 5,761,322 A * 6/1998 Illingworth et al. ..... 381/386
7,578,368 B2 * 8/2009 Yang et al. ..... 181/145

* cited by examiner

*Primary Examiner* — Brian Ensey
(74) *Attorney, Agent, or Firm* — Novak Druce Connolly Bove + Quigg LLP

(57) ABSTRACT

An electronic device includes a housing, a mounting sheet, a circuit board mounted to the housing and the mounting sheet, and a loudspeaker module mounted on the mounting sheet. The housing defines a first receiving chamber and a second receiving chamber communicating with the first receiving chamber at one end of the housing, and a first sound hole corresponding to and communicating the first receiving chamber. The loudspeaker module includes a first loudspeaker which is received in the first receiving chamber. The first receiving chamber communicates the second receiving chamber to form a resonant cavity for the first loudspeaker. The sounds emitted by the first loudspeaker transmit to the outside of the housing by the first sound hole.

10 Claims, 9 Drawing Sheets

ELECTRONIC DEVICE HAVING LOUDSPEAKER MODULE

BACKGROUND

1. Technical Field

The present disclosure generally relates to electronic devices, and particularly to an electronic device having a loudspeaker module.

2. Description of Related Art

Electronic devices (such as mobile phones, personal digital assistants) include loudspeakers. The electronic devices commonly define receiving chambers for receiving the loudspeakers, and resonant cavities for sounds emitted by the loudspeakers to resonate. However, the current receiving chambers and resonant cavities are bulky. As a result, the volume and/or thickness of the electronic device is enhanced.

Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
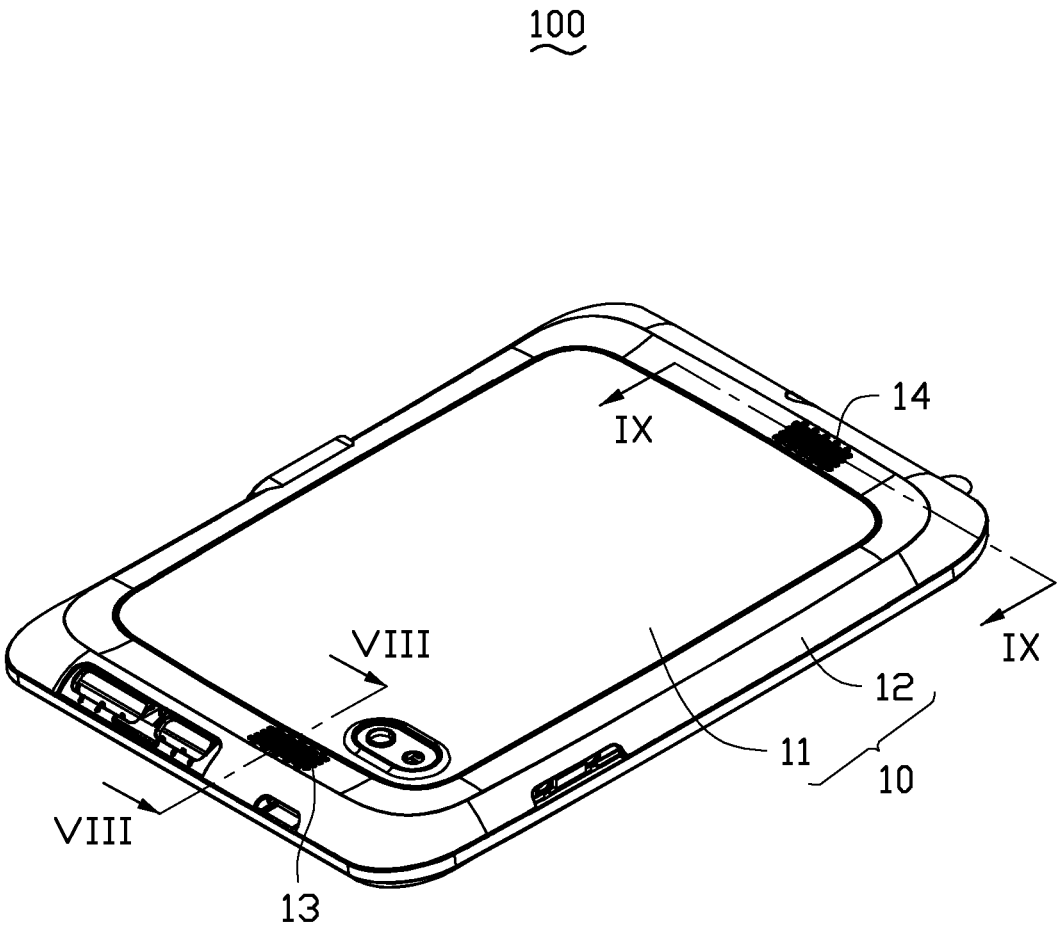
FIG. 1 is a schematic view of an electronic device having a speaker module in accordance with an exemplary embodiment.
Figure 2:
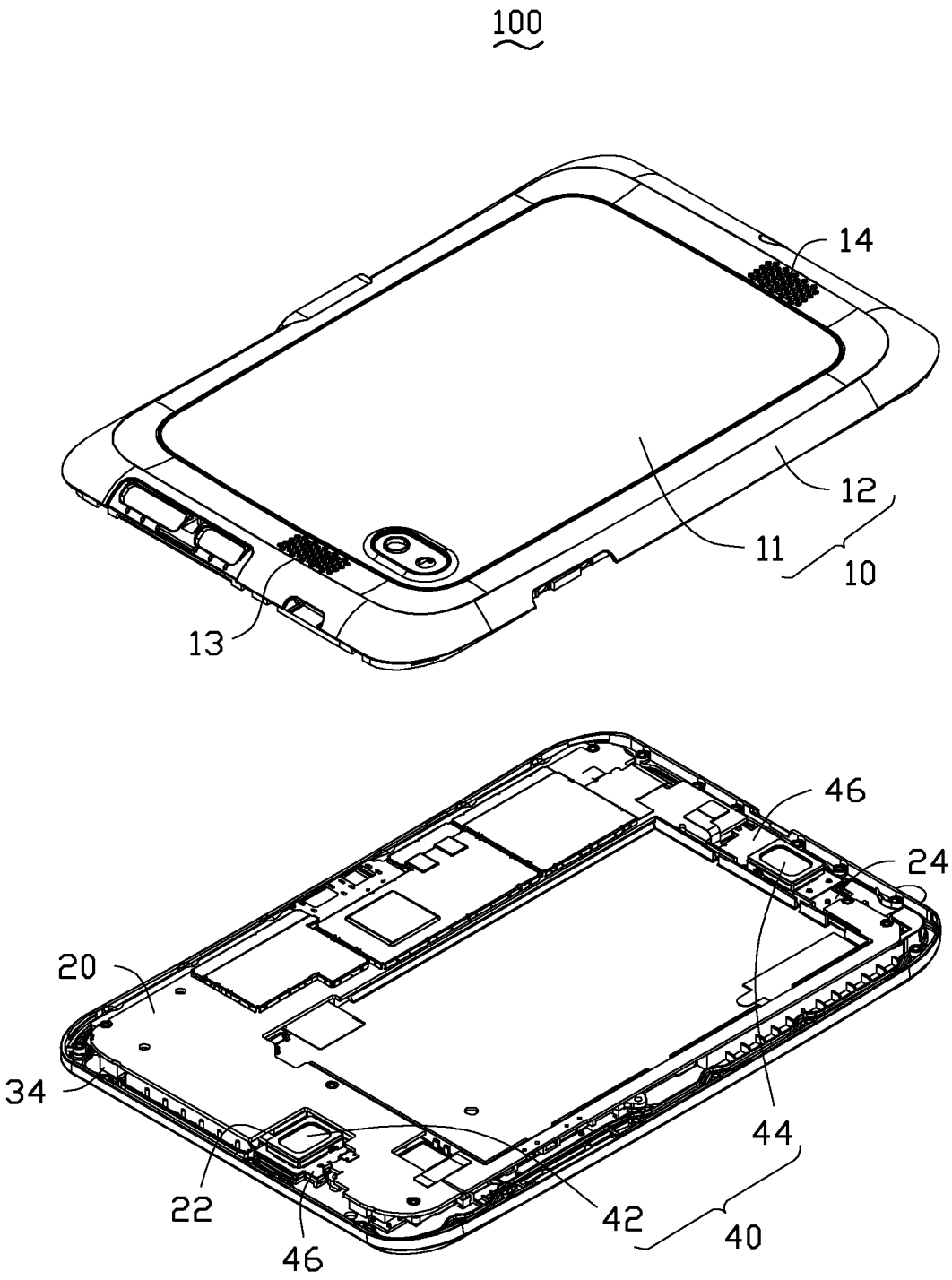
FIG. 2 is an exploded view of the electronic device of FIG. 1.
Figure 3:
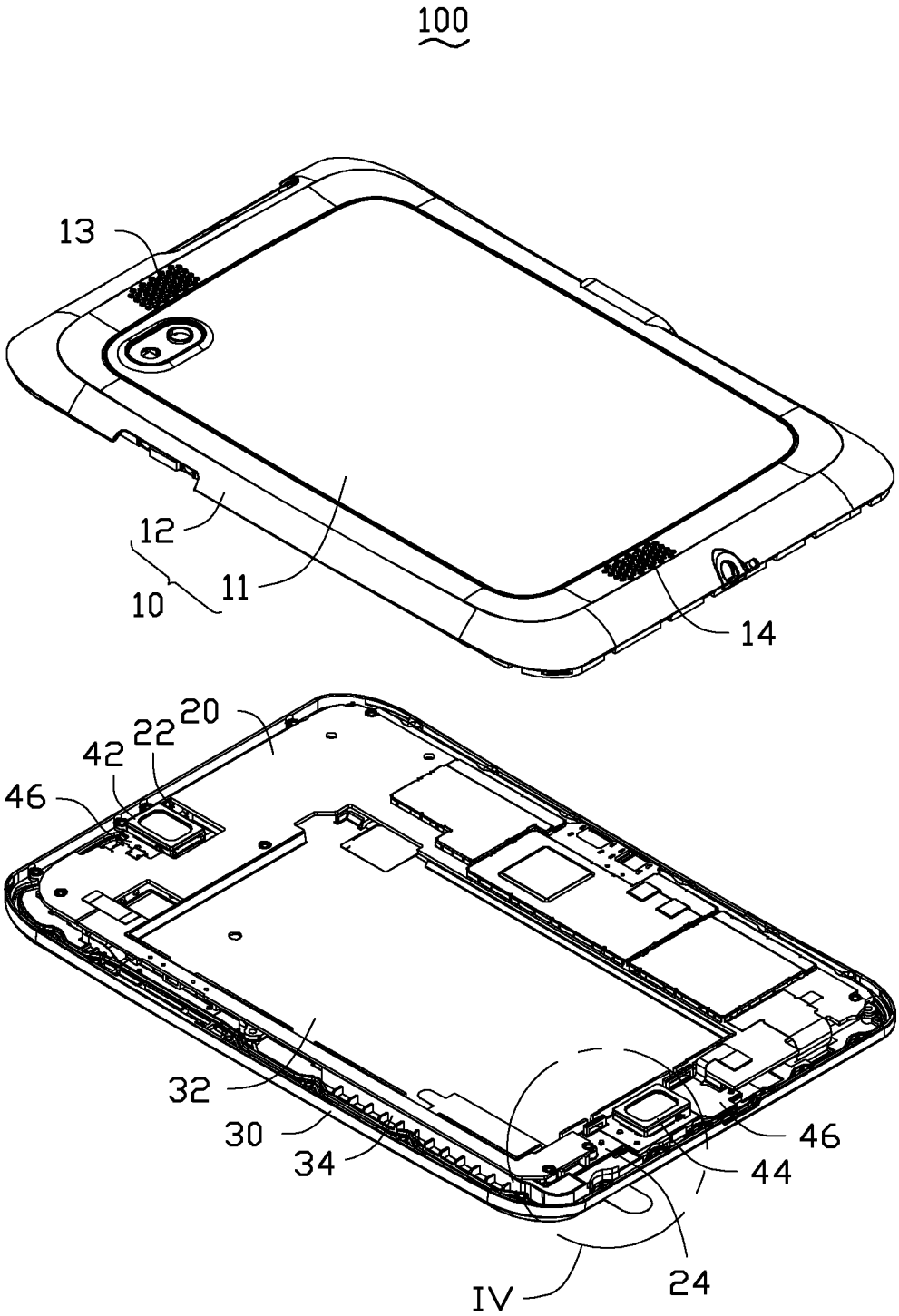
FIG. 3 is another exploded view of the electronic device of FIG. 1.

FIGS. 1-3 show an electronic device 100 (i.e., a mobile phone). The mobile phone is an exemplary application for the purposes of describing details of an exemplary embodiment of an electronic device. The electronic device 100 includes a housing 10, a circuit board 20, a mounting sheet 30, and a loudspeaker module 40. The circuit board 20 is caught between the housing 10 and the mounting sheet 30. The loudspeaker module 40 is mounted on the mounting sheet 30 and received in the housing 10.

Figure 5:
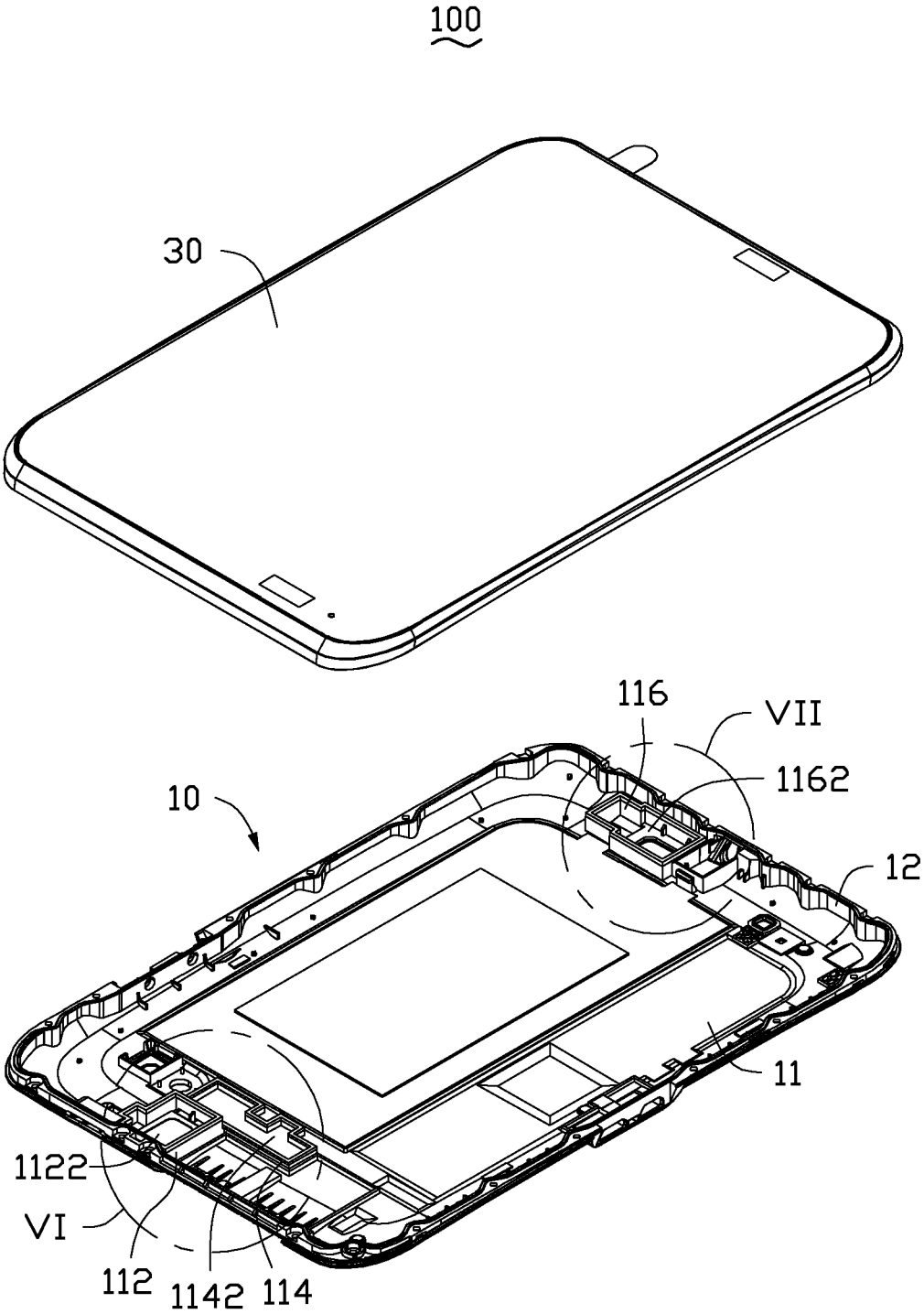
FIG. 5 is an exploded view of the electronic device of FIG. 2 being rotated 180°.
Figure 6:
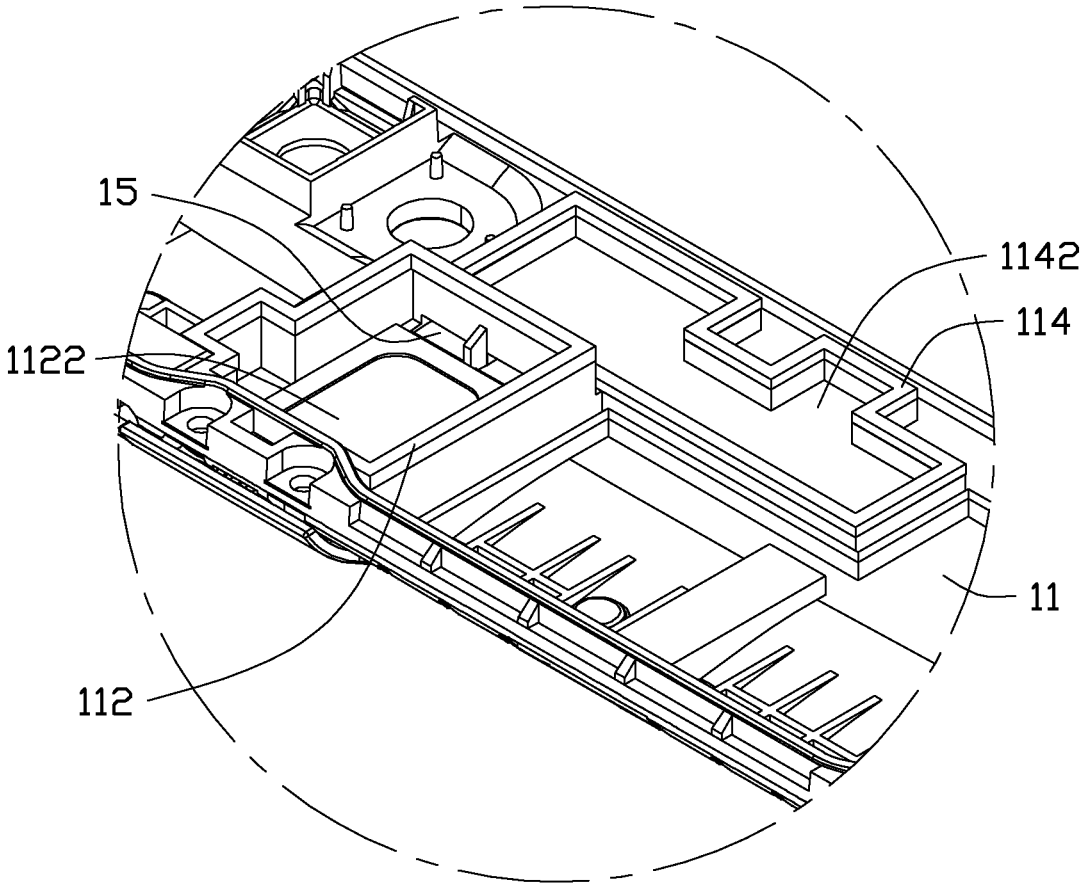
FIG. 6 is an enlarged view of portion VI as shown in FIG. 5.
Figure 7:
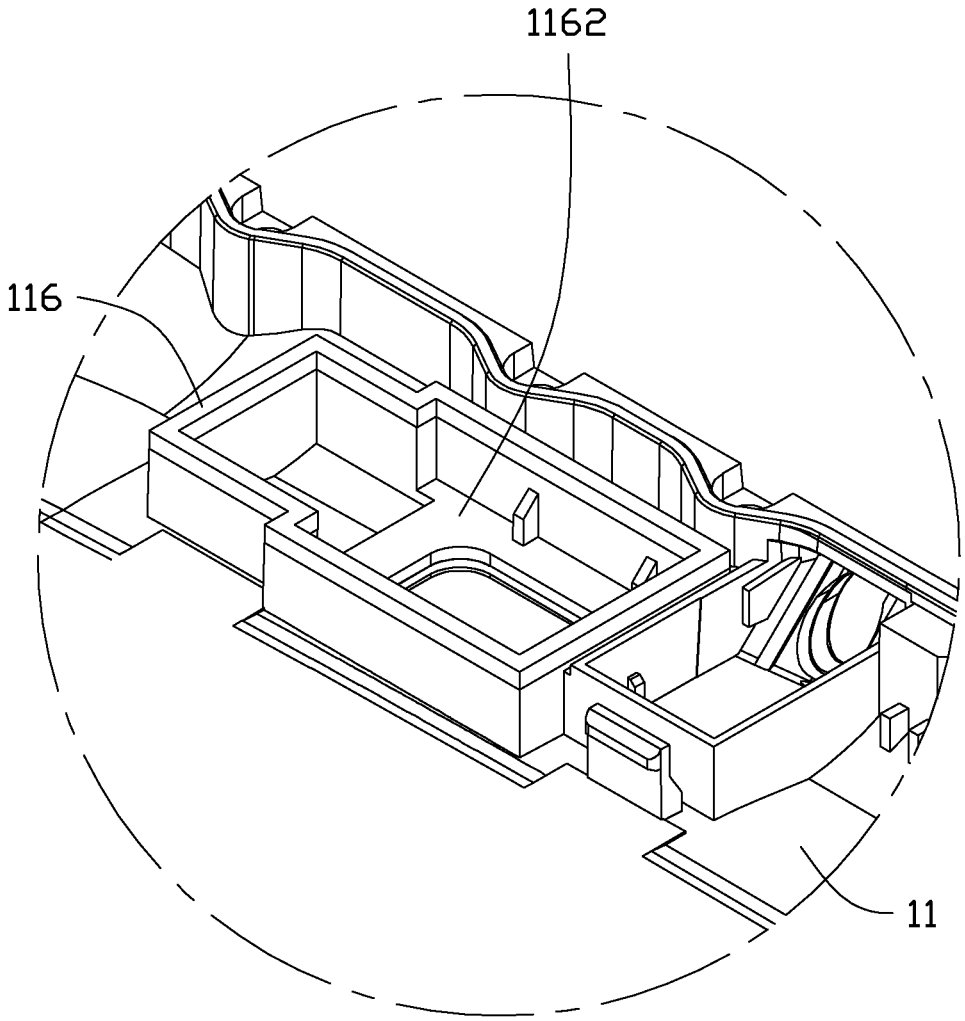
FIG. 7 is an enlarged view of portion VII as shown in FIG. 5.

Referring to FIGS. 5-7, the housing 10 may be a rear cover of the electronic device 100. The housing 10 includes a bottom wall 11 and a peripheral wall 12 protruding from the bottom wall 11. Also referring to FIG. 2, the bottom wall 11 defines a plurality of first sounding holes 13 and a plurality of second sounding holes 14, at the two ends of the bottom wall 11, respectively. The plurality of first and second sounding holes 13 and 14 transmit the sounds emitted by the loudspeaker module 40 to the outside of the housing 10.

A first rib 112 is formed on the inner surface of the bottom wall 11, corresponding to the plurality of first sound holes 13. Abutting the first rib 112, a second rib 114 is also formed on the inner surface of the bottom wall 11. The first rib 112 and the bottom wall 11 cooperate to define a first receiving chamber 1122. The first receiving chamber 1122 communicates the plurality of first sound holes 13. The second rib 114 and the bottom wall 11 cooperate to define a second receiving chamber 1142. The first receiving chamber 1122 and the second receiving chamber 1142 are communicated by a first through hole 15 which is defined by the first rib 112. A third rib 116 is formed on the inner surface of the bottom wall 11, corresponding to the second sound holes 14. The third rib 116 and the bottom wall 11 cooperate to define a third receiving chamber 1162. The third receiving chamber 1162 communicates the plurality of second sound holes 14.

Figure 4:
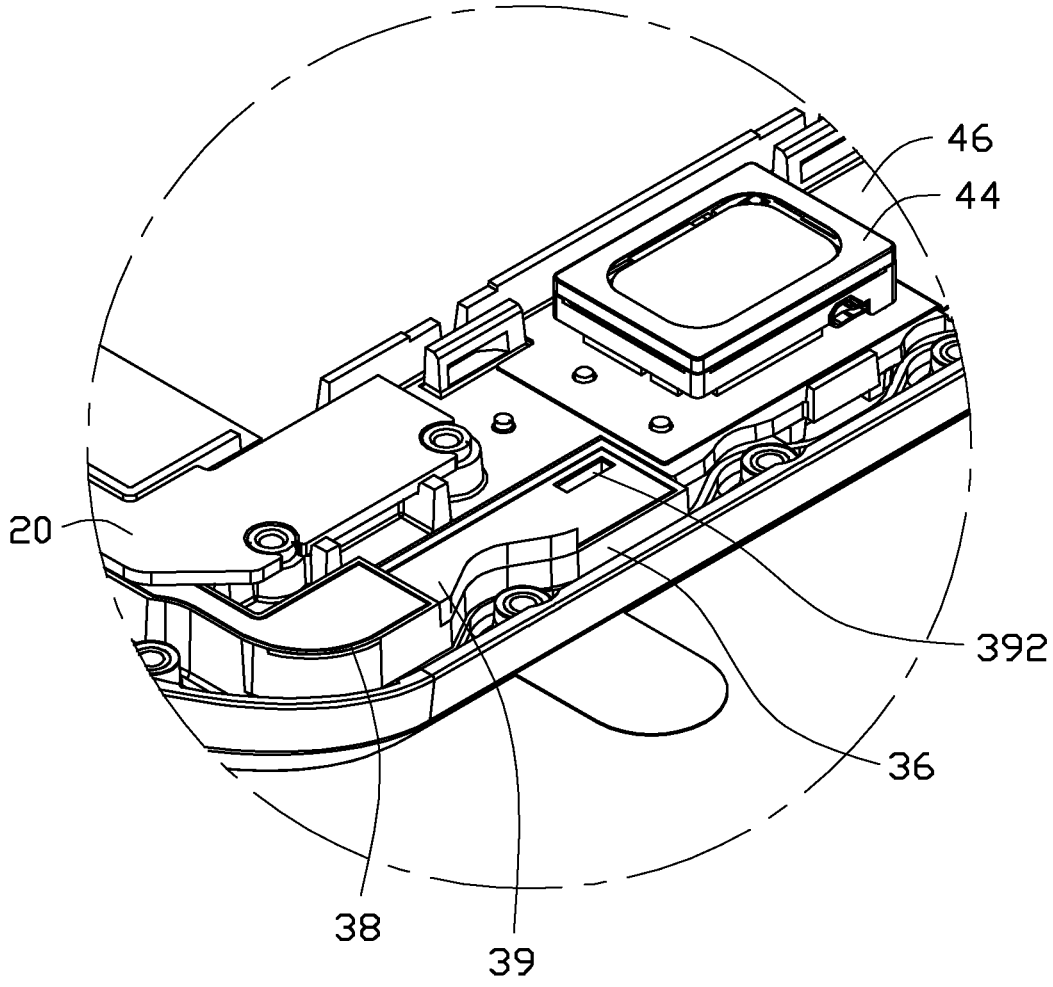
FIG. 4 is an enlarged view of portion IV as shown in FIG. 3.
Figure 9:
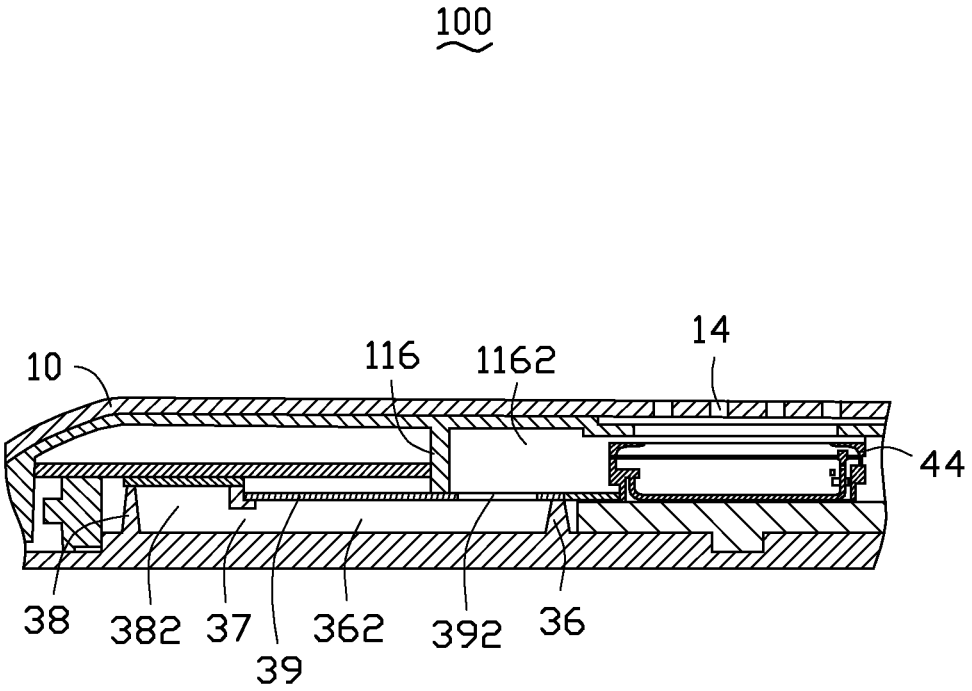
FIG. 9 is a cross-sectional view of the electronic device of FIG. 1 along line IX-IX.

FIGS. 2 and 3 show that the circuit board 20 defines a first opening 22 and a second opening 24, at the two opposite ends of the circuit board 20, respectively. The mounting sheet 30 includes a bottom wall 32 and a flange 34 protruding from the bottom wall 32. The circuit board 20 is supported by the flange 34. Also referring to FIGS. 4 and 9, the mounting sheet 30 further defines a fourth rib 36 and a fifth rib 38 abutting the fourth rib 36, near the second opening 24 of the circuit board 20. The fourth rib 36 and the bottom wall 32 cooperate to form a fourth receiving chamber 362. The fifth rib 38 and the bottom wall 32 cooperate to form a fifth receiving chamber 382. The fourth receiving chamber 362 and the fifth receiving chamber 382 communicate via a second through hole 37 which is defined by the fifth rib 38 (see FIG. 9). The fourth receiving chamber 362 and the fifth receiving chamber 382 are respectively covered by a plate 39, to seal the fourth receiving chamber 362 and the fifth receiving chamber 382. The plate 39 covering the fourth receiving chamber 362 defines a third through hole 392, which communicates the fourth receiving chamber 362 and the third receiving chamber 1162 (see FIG. 9).

The loudspeaker module 40 includes a first loudspeaker 42 and a second loudspeaker module 44, located on the two opposite ends of the bottom wall 32 of the mounting sheet 30, respectively. Further, the first loudspeaker 42 is positioned in the first opening 22 of the circuit board 20, and the second loudspeaker 44 is positioned in the second opening 24 of the circuit board 20. The loudspeaker module 40 further includes two mounting bases 46 electrically connected to the circuit board 20. The first loudspeaker 42 and the second loudspeaker 44 are mounted on the bottom wall 32 by the two mounting bases 46. The first loudspeaker 42 and the second loudspeaker 44 are for emitting sounds. The first loudspeaker 42 has a rear surface facing to the bottom wall 32 of the mounting sheet 30, and a front surface opposite to the bottom wall 32. The second loudspeaker 44 also has a rear surface facing to the bottom wall 32 of the mounting sheet 30, and a front surface opposite to the bottom wall 32.

Figure 8:
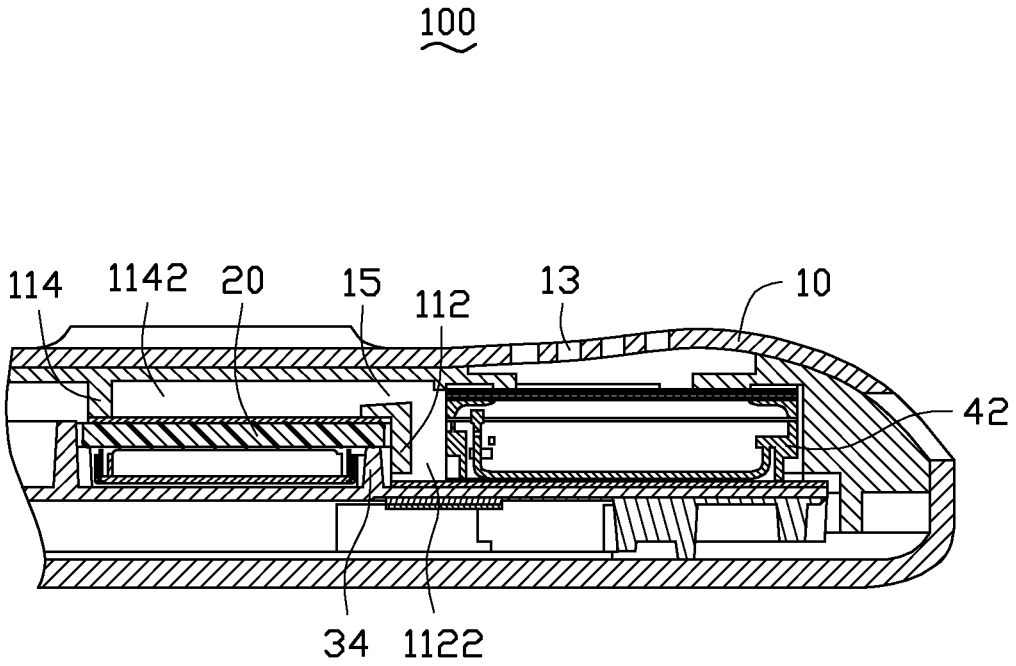
FIG. 8 is a cross-sectional view of the electronic device of FIG. 1 along line VIII-VIII.

During assembly of the electronic device 100, the circuit board 20 is mounted to the flange 34 of the mounting sheet 30 (see FIG. 2). The two mounting bases 46 are mounted on the bottom wall 32 of the mounting sheet 30, at the location corresponding to the first opening 22 and the second opening 24 of the circuit board 20, and electrically connected to the circuit board 20. The first loudspeaker 42 and the second loudspeaker 44 are respectively mounted to one of the mounting bases 46. The housing 10 is engaged to the mounting sheet 30, allowing the peripheral wall 12 of the housing 10 to abut the peripheral portion of the bottom wall 32 of the mounting sheet 30. At this time, the first rib 112 surrounds the first loudspeaker 42 (see FIG. 8). The side of the first rib 112 that abuts the second rib 114 also abuts the circuit board 20, and the side of the first rib 112 opposite to the second rib 114 resists to the bottom wall 32 of the mounting sheet 30. As such, the first loudspeaker 42 is received in the first receiving chamber 1122. The first loudspeaker 42 is adjacent to the side of the first rib 112 opposite to the second rib 114. The front surface of the first loudspeaker 42 faces the first sound holes 13 of the housing 10 (see FIG. 8), and the first receiving chamber 1122 communicates with the first sound holes 13 to form a front resonant cavity of the first loudspeaker 42. The sounds emitted by the front surface of the first loudspeaker 42 transmit to the outside of the housing 10 through the first sound holes 13. The second rib 114 abuts the circuit board 20 (see FIG. 8). As such, a sealed cavity is formed between the first receiving chamber 1122 and the bottom wall 32, and another sealed cavity is formed between the second receiving chamber 1142 and the circuit board 20. The two sealed cavities are communicated by the first through hole 15. The two sealed cavities define a rear resonant cavity of the first loudspeaker 42. The sounds emitted by the rear surface of the first loudspeaker 42 resonate in the rear resonant cavity to improve the quality of the sound transmitted to the outside of the housing 10.

FIGS. 4, 5, 7 and 9 show that the third rib 116 of the housing 10 surrounds the second loudspeaker 44. In addition, the third rib 116 abuts the bottom wall 32 of the mounting sheet 30, and one side of the third rib 116 abuts the fourth rib 36 and the plate 39, allowing the third through hole 392 of the plate 39 to position beside the inner surface of the third rib 116. As such, the third receiving chamber 1162 and the fourth receiving chamber 362 are communicated by the third through hole 392. The second loudspeaker 44 is received in the third receiving chamber 1162, and positioned near the end of the third receiving chamber 1162 away from the fourth receiving chamber 362 (see FIG. 9). The front surface of the second loudspeaker 44 aim at the second sound holes 14, and the third receiving chamber 1162 communicates the second sound holes 14 to form a front resonant cavity of the second loudspeaker 42. The sounds emitted by the front surface of the second loudspeaker 44 transmit to the outside of the housing 10 through the second sound holes 14. The third receiving chamber 1162, the third through hole 392, the fourth receiving chamber 362, the second through hole 37, and the fifth receiving chamber 382 communicate with each other and define a rear resonant cavity of the second loudspeaker 44. The sounds emitted by the rear surface of the second loudspeaker 44 resonate in the rear resonant cavity to improve the quality of the sound transmitted to the outside of the housing 10.

The exemplary electronic device 100 defines resonant cavities of the first loudspeaker 42 and the second loudspeaker 44 by using the cavities between the loudspeakers and the housing 10, circuit board 20, and mounting sheet 30, which reduces the volume and/or thickness of the electronic device 100.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. An electronic device having loudspeaker module, comprising:

a housing, the housing defining a first receiving chamber and a second receiving chamber communicating with the first receiving chamber at one end of the housing, and a first sound hole corresponding to and communicating with the first receiving chamber;

a mounting sheet comprising a bottom wall and a flange protruding from the bottom wall;

a circuit board mounted to the housing and the mounting sheet and supported by the flange; and a loudspeaker module mounted on the mounting sheet, the loudspeaker module comprising a first loudspeaker received in the first receiving chamber;

wherein the first receiving chamber communicates with the second receiving chamber to form a resonant cavity for the first loudspeaker;

wherein the housing comprises a bottom wall and a peripheral wall protruding from the bottom wall, a first rib is formed on the inner surface of the bottom wall, and a second rib is also formed on the inner surface of the bottom wall abutting the first rib, the first rib and the bottom wall cooperate to define the first receiving chamber, the second rib and the bottom wall cooperate to define the second receiving chamber; the first receiving chamber and the second receiving chamber are communicated by a first through hole defined by the first rib;

wherein the circuit board defines a first opening, the first loudspeaker is positioned in the first opening, the first rib surrounds the first loudspeaker, the side of the first rib abutting the second rib abuts the circuit board, and the side of the first rib opposite to the second rib abuts the bottom wall of the mounting sheet, the first loudspeaker is adjacent to the side of the first rib opposite to the second rib.

2. The electronic device as claimed in claim 1, wherein the housing further defines a third receiving chamber at an opposite end of the housing, and a second sound hole corresponding to and communicating with the third receiving chamber, the loudspeaker module further comprises a second loudspeaker received in the third receiving chamber, the mounting sheet defines a fourth receiving chamber and a fifth receiving chamber adjacent to the third receiving chamber, the third receiving chamber, the fourth receiving chamber, and the fifth receiving chamber communicate with each other to form a resonant cavity for the second loudspeaker.

3. The electronic device as claimed in claim 2, wherein the loudspeaker module further comprises two mounting bases electrically connected to the circuit board, the first loudspeaker and the second loudspeaker are mounted on the mounting sheet by the two mounting bases.

4. The electronic device as claimed in claim 2, wherein a third rib is defined on the inner surface of the bottom wall, the third rib and the bottom wall of the housing cooperate to define the third receiving chamber.

5. The electronic device as claimed in claim 2, wherein the mounting sheet further comprises a fourth rib and a fifth rib abutting the fourth rib, the fourth rib and the bottom wall of the mounting sheet cooperate to form the fourth receiving chamber, the fifth rib and the bottom wall of the mounting sheet cooperate to form the fifth receiving chamber, the fourth receiving chamber and the fifth receiving chamber are communicated by a second through hole defined by the fifth rib.

6. The electronic device as claimed in claim 5, wherein the third rib of the housing surrounds the second loudspeaker, the fourth receiving chamber and the fifth receiving chamber are covered by a plate, the plate covered on the fourth receiving chamber defines a third through hole, one side of the third rib abut the fourth rib and the plate, allowing the third through hole of the plate to locate beside the inner surface of the third rib to communicate the third receiving chamber and the fourth receiving chamber, thereby the third receiving chamber, the third through hole, the fourth receiving chamber, the second through hole, and the fifth receiving chamber communicate with each other to define a rear resonant cavity for the second loudspeaker.

7. The electronic device as claimed in claim 6, wherein the second loudspeaker is positioned near the end of the third receiving chamber away from the fourth receiving chamber.

8. The electronic device as claimed in claim 2, wherein the circuit board defines a second opening, the second loudspeaker is positioned in the second opening, the second loudspeaker faces the second sound hole, the third receiving chamber communicates the second sound hole to form a front resonant cavity for the second loudspeaker.

9. The electronic device as claimed in claim 1, wherein the first loudspeaker faces the first sound hole of the housing, the first receiving chamber communicates the first sound hole to form a front resonant cavity of the first loudspeaker, sounds emitted by the first loudspeaker transmit to the outside of the housing through the first sound hole.

10. The electronic device as claimed in claim 1, wherein the first rib abuts the circuit board to form a sealed cavity between the first receiving chamber and the bottom wall, and the second rib abuts the circuit board to form another sealed cavity between the second receiving chamber and the circuit board, the two sealed cavities are communicated by the first through hole to define a rear resonant cavity for the first loudspeaker.

* * * * *